US006198444B1

(12) United States Patent
Sailsman et al.

(10) Patent No.: US 6,198,444 B1
(45) Date of Patent: Mar. 6, 2001

(54) DOUBLE POLE LIMIT SWITCH HAVING AN ACTUATOR AS A POLE

(75) Inventors: Michael E. Sailsman, Miami; John Delianides, Wellington; Keith W. Nuetzman, West Palm Beach, all of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/436,641

(22) Filed: Nov. 9, 1999

(51) Int. Cl.[7] ..... H01Q 1/24
(52) U.S. Cl. ..... 343/702; 343/876
(58) Field of Search ..... 343/702, 876, 343/901; 335/129, 207; 455/90; H01Q 1/24

(56) References Cited

U.S. PATENT DOCUMENTS 4,163,132 * 7/1979 Reiter ..... 200/153 M
4,489,397 * 12/1984 Haydon et al. ..... 335/207
5,138,329 8/1992 Saarnimo et al. ..... 343/702
5,739,792 4/1998 Hassemer et al. ..... 343/702
5,754,141 5/1998 Thompson et al. ..... 343/702
5,854,972 12/1998 Pennock et al. ..... 455/126
5,886,601 * 3/1999 Kitamura et al. ..... 335/129

* cited by examiner

*Primary Examiner*—Don Wong
*Assistant Examiner*—Shih-Chao Chen

(57) ABSTRACT

A double pole limit switch (340) includes an insulator (410), a conductive spring element (420), and a conductive element (430). The conductive spring element is attached to the insulator for providing spring coupling between a substrate (210) and the insulator, and has a first electrical contact (355) and a conductive substrate attachment portion (425). The conductive element is attached to the insulator and has a second electrical contact (350) and a conductive actuator feature (435). The first and second electrical contacts are moved into a plane of the conductive substrate attachment portion by application of opposing forces to the conductive actuator feature and the conductive substrate attachment portion.

11 Claims, 4 Drawing Sheets

DOUBLE POLE LIMIT SWITCH HAVING AN ACTUATOR AS A POLE

FIELD OF THE INVENTION

This invention relates in general to limit switches and in particular to a double pole limit switch suitable for a wireless communication device.

BACKGROUND OF THE INVENTION

When an antenna of a wireless communication device such as a cellular telephone is retracted, it is sometimes desirable to alter the power of a radio frequency signal that is coupled to the antenna, so as to increase or decrease the amount of radio frequency energy that is applied to the antenna. When a whip antenna is used, there is also a need to add passive electrical loading at the end of the antenna when the antenna is retracted. There are known techniques of accomplishing these objectives, but they require several mechanical and electrical parts. In one prior art technique used for an antenna having a helical portion, a matching circuit is connected to the feed point of the antenna and the opposite end of the antenna is grounded when the antenna is retracted. This technique which is described in U.S. Pat. No. 5,739,792, entitled "Wireless Communication Device with Electrical Contacts", that issued to Hassemer et al. on Apr. 14, 1998 (hereinafter, "Hassemer"), and that is incorporated herein by reference, uses two independent switch mechanisms (reference numbers 32, 38) formed of conductive spring metal that are spring loaded and that each make contact to the antenna in the retracted position, plus a conductive spring element (36) that is in contact with the antenna in both the retracted and extended positions. This arrangement works well enough but is more complicated than is necessary for a whip antenna that benefits from a load circuit that is connected only in the retracted position.

Thus, what is needed is a simpler and less costly technique of adding an electrical load to a retracted antenna and changing the power of a transmit signal coupled thereto when it is retracted.

DESCRIPTION OF A PREFERRED EMBODIMENT

Figure 1:
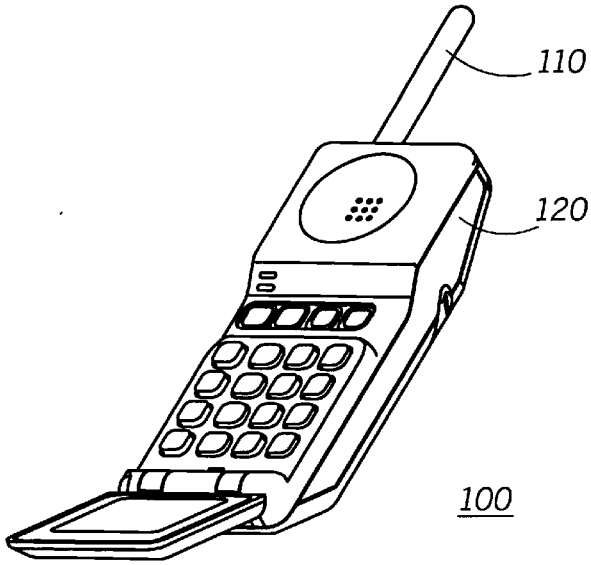
FIG. 1 is an illustration showing a portable telephone having a retractable antenna, in accordance with the preferred embodiment of the present invention.

Referring to FIG. 1, a portable telephone 100 having a retractable antenna 110 is illustrated with the antenna 110 in an extended position, in accordance with the preferred embodiment of the present invention. The portable telephone 100 is representative of any radio device that has an antenna that is extendible and retractable through a housing 120 of the portable telephone, such as a two way portable radio, a cellular radio, or a home remote telephone, and for which there is a benefit of automatically changing the power of a radio frequency (RF) signal coupled to the antenna 110 when it is in a predetermined position such as, for example, retracted, or, as another example, halfway extended. In some instances it may be preferable to increase the RF power coupled to the antenna 110 when it is halfway extended: for example, the technique of the present invention can be used to save battery life while the user is within short range of a base station, while having the RF power at its greatest is not a concern, in a radio system that does not provide power control commands. The antenna 110 is preferably a whip antenna, but could be of another type, such as an antenna that has a helical portion.

Figure 2:
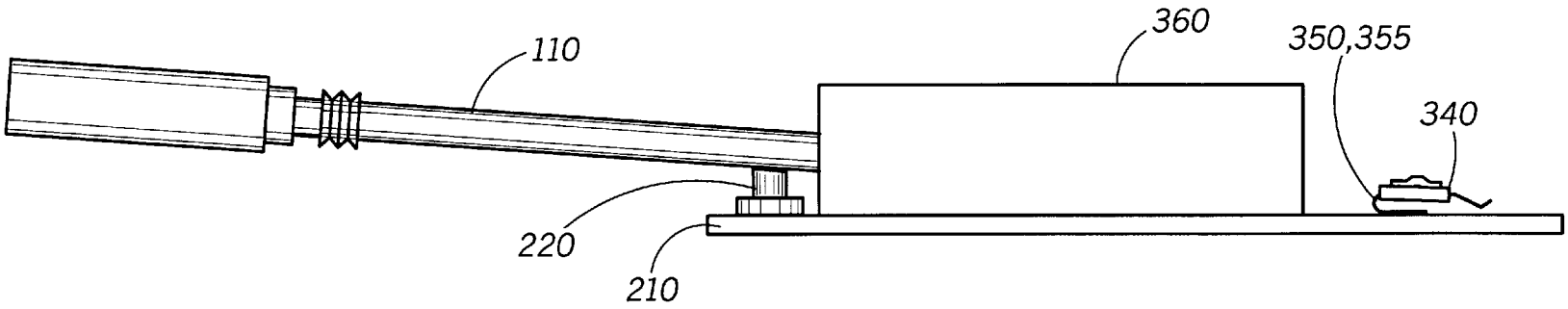
FIGS. 2 and 3 are side view mechanical drawings of the antenna and other parts of the portable telephone showing the antenna and a circuit board, in accordance with the preferred embodiment of the present invention.
Figure 3:
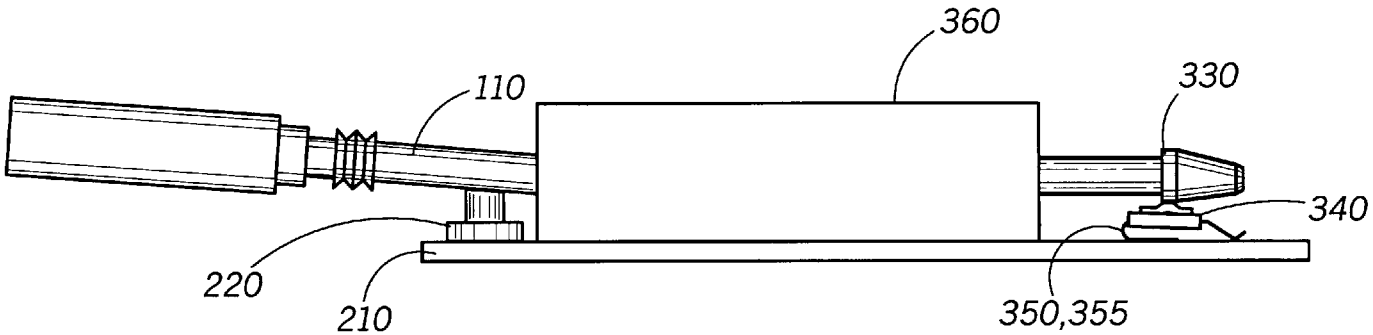

Referring to FIGS. 2 and 3, side view mechanical drawings of parts of the portable telephone 100 show the antenna 110 and a printed circuit (PC) board 210, in accordance with the preferred embodiment of the present invention. The antenna 110 is extended in FIG. 2 and retracted in FIG. 3. In FIG. 2, a radio frequency (RF) feed 220 makes contact with the antenna when it is in the extended position. The RF feed 220 couples a radio frequency (RF) signal to the antenna 110, which radiates the RF signal.

When the user retracts the antenna 110, as shown in FIG. 3, a tapered end 330 of the antenna 110 presses against an actuator of a unique double pole switch 340, causing contacts 350, 355 of the switch 340 to press against respective conductive pads on the PC board 210. When the antenna 110 is extended and retracted, the tapered end 330 and body of the antenna 110 are guided by a guide 360 that is mounted to the PC board 210. The guide 360 is preferably made of plastic. When the tapered end 330 of the antenna moves away from the switch 340, the contacts 350, 355 move away from the PC board 210 by spring action.

Figure 4:
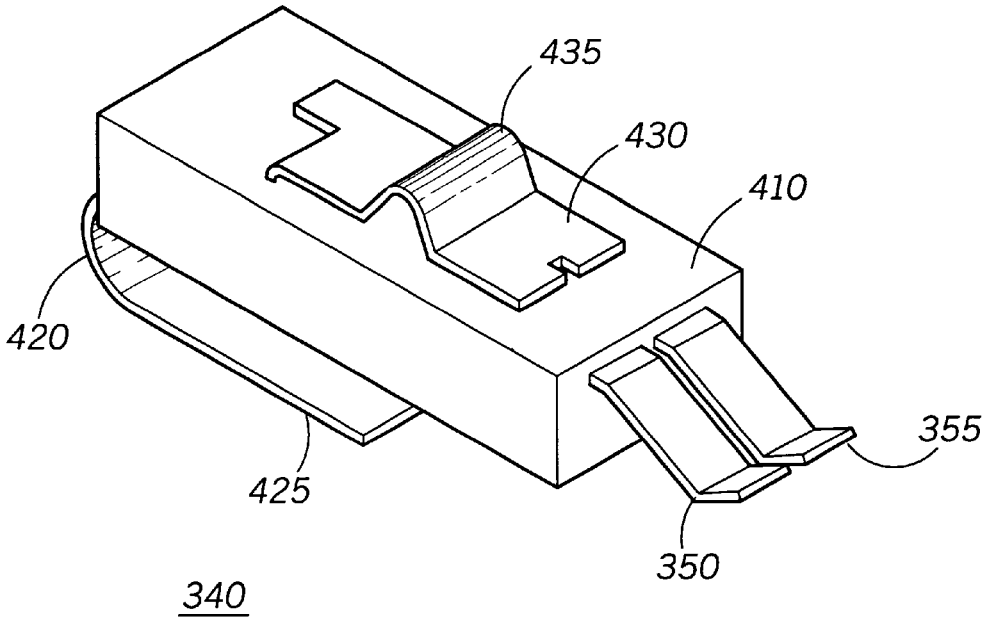
FIGS. 4 and 5 are mechanical drawings showing perspective views of an antenna switch used with the antenna, in accordance with the preferred embodiment of the present invention.
Figure 5:
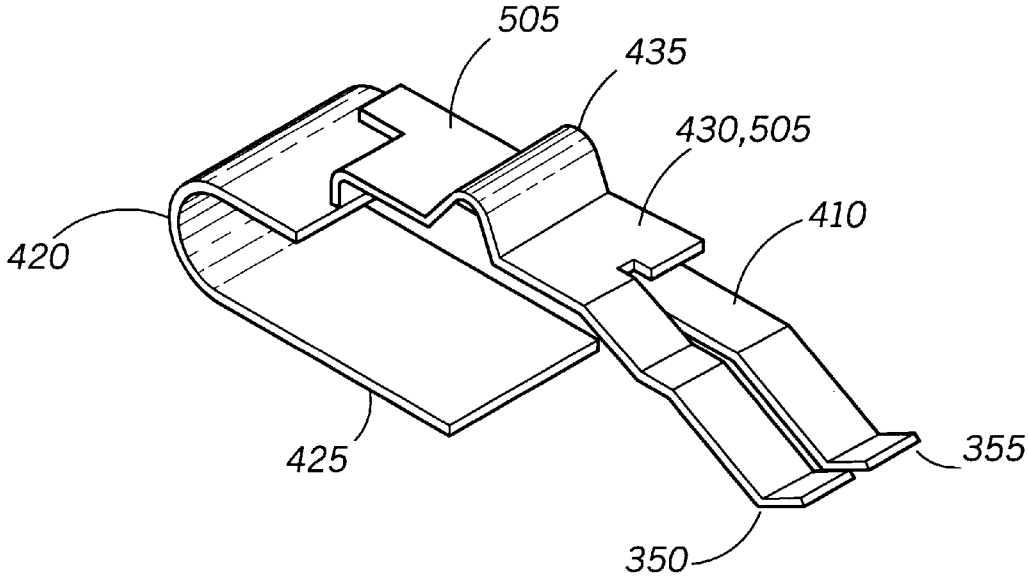

Referring to FIG. 4 a mechanical drawing shows a perspective view of the switch 340, in accordance with the preferred embodiment of the present invention. The antenna switch 340 comprises, and preferably consists only of, three parts: a conductive spring element 420, a conductive element 430, and an insulator 410. Portions of both the conductive spring element 420 and conductive element 430 are molded into the insulator 410, but do not touch each other. The conductive spring element 420 is preferably a single formed, plated piece of spring sheet metal that has a portion that is a substrate attachment 425, and has a portion that is the contact 355. The substrate attachment 425 is preferably planar and shaped to fit on an essentially matching circuit pad on the printed circuit board 210, for soldering thereto. The conductive spring element 420 is formed having a U shaped feature so that the contact 355 is above the plane of the substrate attachment 425 when there is are no external forces acting on the conductive spring element 420. The conductive element 430 is preferably a single formed, plated piece of spring sheet metal that has a portion that is an actuator 435, and has a portion that is the contact 350. The conductive element 430 is formed with flat portions 505 that are situated on top of the insulator 410, such that the contact 355 is above the plane of the substrate attachment 425 when the conductive spring element 420 and conductive elements 430 are molded into the insulator 410 and there is are no external forces acting on the switch 340. For better clarity, FIG. 5 shows a perspective view of the conductive spring element 420 and the conductive element 430 as they are situated within the insulator 410.

Figure 6:
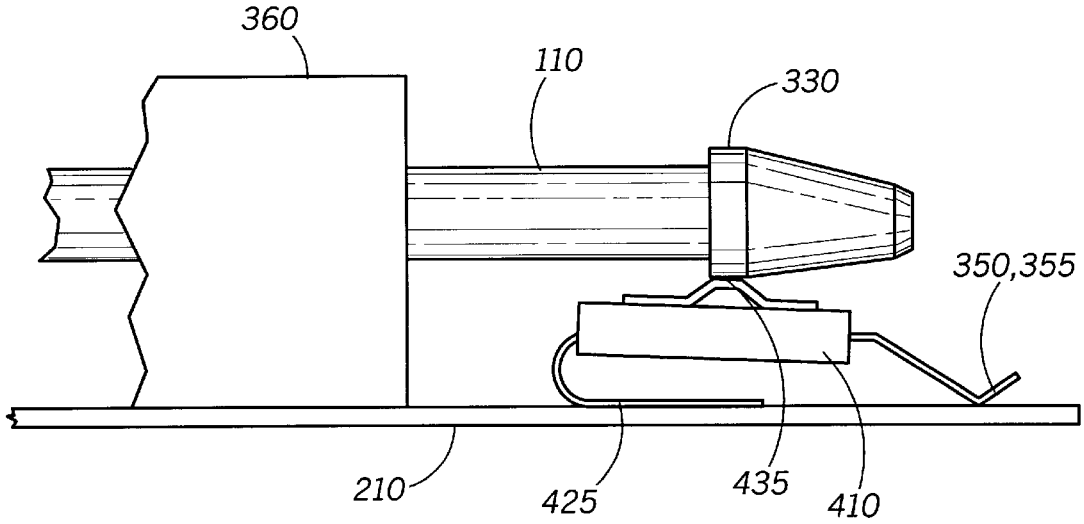
FIG. 6 is a mechanical drawing showing a side view of the antenna switch and antenna, when the antenna is retracted, in accordance with the preferred embodiment of the present invention.

Referring to FIG. 6, a mechanical drawing shows a close-up side view of the antenna switch 340 and the tapered end of the antenna 110, when the antenna 110 is retracted, in accordance with the preferred embodiment of the present invention. It will be appreciated that when the antenna 110 is retracted, the tapered end 330 of the antenna 110 presses on the actuator 435 in a direction essentially toward the substrate attachment 425 and the PC board 210, which moves the conductive spring element 420 toward the PC board 210. The contacts 350, 355 are pressed against contact pads on the PC board 210 each time the switch 340 is activated because the contacts 350, 355 are on arms that are formed from the spring metal that forms the conductive spring element 420 and the conductive element 430. The conductive spring element 420 and the conductive element 430 can be made of materials other than plated spring sheet metal, such as plated spring wire. If made of wire, the wire would have to be formed to provide the characteristics of a substrate attachment (such as a flat spiral portion, an actuator portion, and contact portions). It will be appreciated that the switch 340 is a double pole limit switch having the substrate attachment 425 and the actuator 435 as the two poles. When the antenna 110 is extended, the tapered end 330 no longer touches the actuator 435, and with no external force acting on the actuator 435 (the force of gravity is insignificant in this situation), the conductive spring element 420 moves the contacts 350, 355 out of the plane of the PC board 210.

Figure 7:
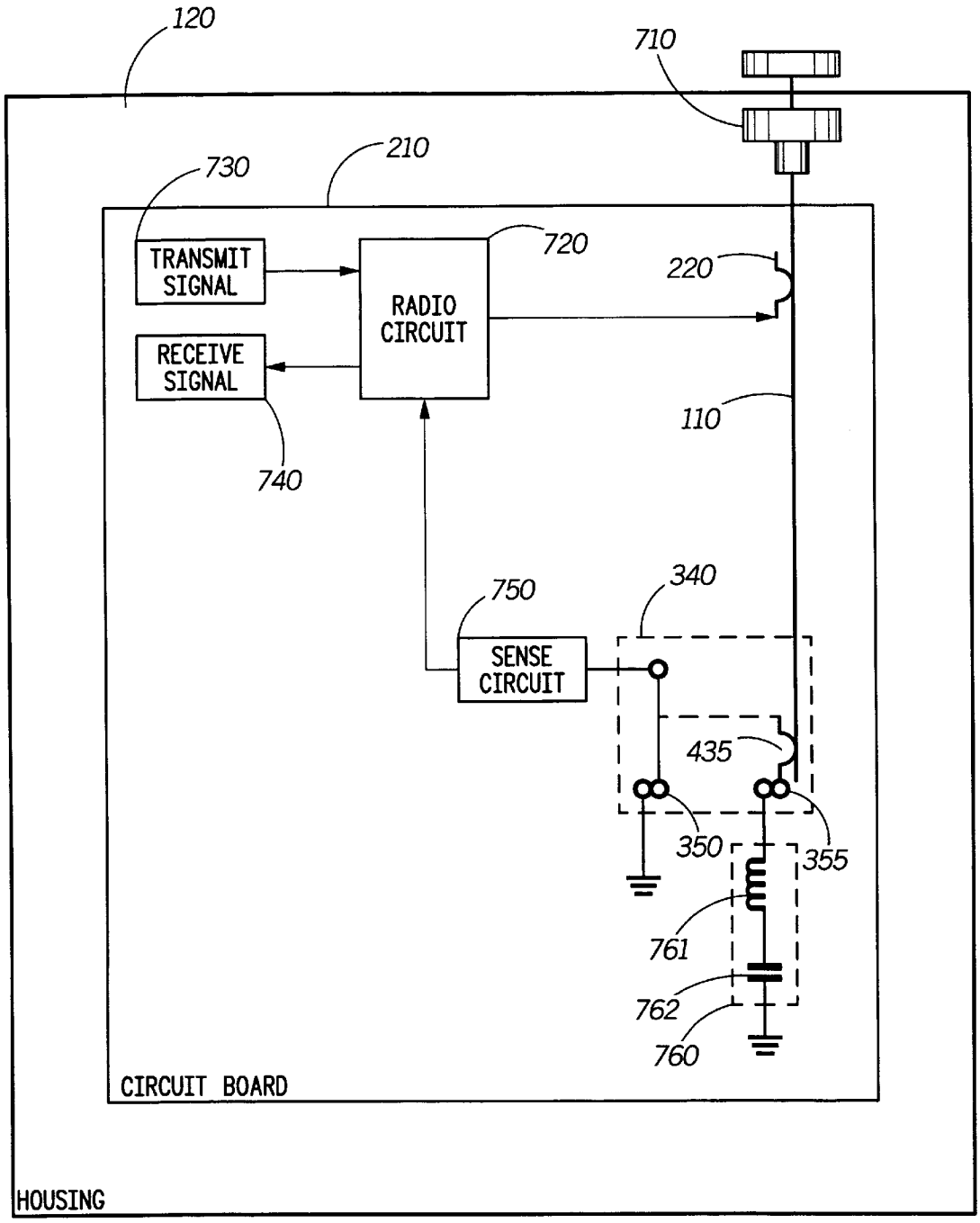
FIG. 7 is an electrical schematic and block diagram showing the mechanical switch and radio circuits of the portable telephone, in accordance with the preferred embodiment of the present invention.

Referring to FIG. 7, an electrical schematic and block diagram shows the switch 340 and circuits of the cellular telephone 100 in a situation where the antenna is retracted, in accordance with the preferred embodiment of the present invention. Mounted on PC board 210 are the radio frequency (RF) feed 220, the switch 340, a sense circuit 750, a radio circuit 720, a transmit signal generator 730, a receive signal processor 740, and a load circuit 760. The radio circuit 720 at times generates a transmit signal that is coupled by the RF feed 220 to the antenna 110 whether the antenna is extended or retracted. The radio circuit 720 at times receives a signal coupled to the radio circuit 720 through the RF feed 220 whether the antenna is extended or retracted. When the radio circuit 720 receives a signal, it generates a demodulated signal that is coupled to the receive signal processor which processes it in a conventional manner, such as digitized voice synthesizing. When the radio circuit 720 transmits a signal, it does so in response to a transmit signal generated by the transmit signal generator, which is a conventional transmit signal generator, such as a conventional voice compression encoder.

When the antenna 110 is retracted, the pressure of the antenna 110 on the actuator 435 (and the responsive force of the PC board 210) cause the contact 355 to make connection with a contact pad on the PC board that is coupled to the antenna load 760. Because the actuator 435 itself is conductive, the antenna load 760 is thereby coupled to the antenna 110 near the tapered end 330. The antenna load 760 is a conventional antenna load that properly optimizes the impedance characteristics of the whip antenna 110 this is retracted. The determination of the exact nature of the impedance is well known to one of ordinary skill in the art, and is shown here as an inductance 761 coupled in series to a capacitance, coupled in series to a ground reference. The movement of the actuator 435 is coupled to the conductive spring element 420 of the switch 340 by the insulator 410, which causes the contact 350 to make connection with another pad on the PC board 210. The other pad on the PC board is coupled to a ground reference, and the substrate attachment of the conductive spring element 420 is coupled by a runner on the PC board to the sense circuit 750, which then senses the ground reference and generates a control signal that is coupled to the radio circuit 720. Upon sensing the control signal, the radio circuit 720 alters the power of any transmit signal that it generates to be ½ of what it would otherwise be.

It will be appreciated that the collar could have shapes other than those shown in FIGS. 2, 3, and 6, while still providing the functionality described herein above. It will be further appreciated that the whip antenna 110 can be alternatively designed, and the switch 340 can be placed elsewhere on the PC board 210 with respect to the antenna 110, so that the antenna load 760 is connected only at the middle position of the retraction of the antenna by having, for example, a collar in the middle of the antenna shaft that is tapered at both ends. As another alternative the antenna load 760 can be connected for all positions below the middle position of retraction by having, for example, the lower portion of the antenna shaft thicker than the upper. The tapered end 330 of the antenna 100, the collar in the middle of the antenna 110, or the thicker portion of the antenna shaft can be generalized as conductive actuating features of the antenna that provide coupling of the antenna 110 to the antenna load at one or more predetermined positions of the antenna, and non coupling at other predetermined position (s) of the antenna.

Thus, it can be seen that, in accordance with the preferred embodiment of the present invention, a unique and simple three piece double pole limit switch 340 provides the combined functions of coupling a load circuit 760 and a sense circuit 750 to the whip antenna 110 when the antenna is retracted. The double pole limit switch 340 has a conductive actuator 435 that acts as one of the two poles.

What is claimed is:

1. A double pole limit switch comprising:

a first movable contact for making electrical contact;

a second movable contact for making electrical contact;

a substrate attachment electrically coupled to the first movable contact, for mechanically attaching the double pole limit switch and electrically coupling the substrate attachment to an attachment pad on a circuit substrate;

a conductive actuator, for moving the first and second movable contacts into a plane of the circuit substrate when a device presses the conductive actuator generally toward the substrate attachment; and a spring element that returns the first and second movable contacts out of the plane of the circuit substrate when no external force acts on the conductive actuator.

2. A double pole limit switch comprising:

an insulator, a conductive spring element attached to the insulator for providing spring coupling between a substrate and the insulator, and having a first electrical contact and a conductive substrate attachment portion; and a conductive element that is attached to the insulator, having a second electrical contact and a conductive actuator feature, wherein the first and second electrical contacts are moved into a plane of the conductive substrate attachment portion by application of opposing forces to the conductive actuator feature and the conductive substrate attachment portion.

3. The double pole limit switch according to claim 2, wherein the conductive spring element is a formed, plated, piece of spring sheet metal.

4. The double pole limit switch according to claim 2, wherein the conductive spring element is a formed, plated, wire spring.

5. A wireless radio communication device, comprising:

an antenna;

a planar substrate having first, second, and third conductive pads; and a switch, comprising an insulator, a conductive spring element that is electrically coupled to the third conductive pad, that is mechanically attached to provide spring coupling between the planar substrate and the insulator, and that has a first contact; and a conductive element that is attached to the insulator, having a second contact and a conductive actuator feature, wherein pressure applied to the conductive actuator feature by a portion of the antenna when the antenna is in a first position moves the first and second contacts into contact, respectively, with the first and second conductive pads and causes a first electrical coupling between the first conductive pad and the antenna and causes a second electrical coupling between the second conductive pad and the third conductive pad, and wherein the first and second electrical couplings are broken at a second position of the antenna.

6. The wireless radio communication device according to claim 5, wherein the conductive spring element is formed, plated flat spring metal.

7. The wireless radio communication device according to claim 5, wherein the conductive spring element is formed, plated wire spring metal.

8. The wireless radio communication device according to claim 5, wherein the antenna has an insulated end and a conductive actuating feature, and wherein the first electrical coupling between the first conductive pad and the antenna is responsive to the conductive actuating feature engaging the conductive actuator feature.

9. The wireless radio communication device according to claim 5, further comprising:

a load circuit on the substrate that is coupled to the second conductive pad; and an antenna sense circuit coupled to the first conductive pad.

10. The wireless radio communication device according to claim 9, further comprising a transmit circuit that generates a transmit signal having an output power coupled to the antenna, wherein the transmit circuit is coupled to the antenna sense circuit, and wherein the output power is reduced by the transmit circuit in response to a signal generated by the antenna sense circuit in response to the second electrical coupling.

11. A double pole single throw switch consisting of:

an insulator, a conductive spring element attached to the insulator for providing spring coupling between a substrate and the insulator, and having a first electrical contact and a conductive substrate attachment portion; and a conductive element that is attached to the insulator, having a second electrical contact and a conductive actuator feature, wherein the first and second electrical contacts are moved into a plane of the conductive substrate attachment portion by application of opposing forces to the conductive actuator feature and the conductive substrate attachment portion.

* * * * *